US006231396B1

(12) United States Patent
Huang

(10) Patent No.: US 6,231,396 B1
(45) Date of Patent: May 15, 2001

(54) JACK CONNECTOR

(75) Inventor: Nan Tsung Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/474,574

(22) Filed: Dec. 29, 1999

(51) Int. Cl.[7] ..... H01R 24/04
(52) U.S. Cl. ..... 439/668
(58) Field of Search ..... 439/668, 669, 439/188

(56) References Cited

U.S. PATENT DOCUMENTS 4,695,116 * 9/1987 Bailey et al. ..... 439/668
5,092,795 * 3/1992 Kitagawa ..... 439/668
5,919,052 * 7/1999 Ho ..... 439/668
6,000,970 * 12/1999 Wu ..... 439/668

* cited by examiner

*Primary Examiner*—Gary F. Paumen
(74) *Attorney, Agent, or Firm*—Wei Te Chung

(57) ABSTRACT

An electrical connector comprises a housing, a holding member for being received at a bottom end of the housing, a first contact and a pair of second contacts. The holding member defines a pair of grooves for retaining the second and a cutout for holding the first contact. The first contact has a base, a connecting plate connecting with a soldering plate, and a pair of engaging plates upwardly depending from the base for mating with a head of a mated plug. Each of the second contacts has a base, a soldering beam projecting outwardly from a bottom end thereof, and an engaging beam extending inwardly from a top end thereof. A pair of shoulders projects from lateral sides of the base for securing the second contact in the holding member. The second contacts are designed to provide desirable resiliency.

1 Claim, 6 Drawing Sheets

JACK CONNECTOR

BACKGROUND OF THE INVENTION

1. Field of the Invention

The present invention relates to a jack connector, and particularly to an audio jack connector which has contacts with desirable resiliency.

2. Brief Description of the Prior Art

U.S. Pat. No. 5,092,795 discloses a conventional connector 6 (shown in FIG. 6) which comprises a dielectric housing 101, a metallic grounding shroud 500 enclosing the housing 101, a conductive grounding contact 200, a first contact 300 and a second contact 400.

The housing 101 includes a case 103 for receiving the contacts 200, 300 and 400 and a sleeve 102 forwardly projecting from the case 103 through which a complementary plug (not shown) is inserted. The U-shaped grounding shroud 500 forms a grounding leg 501 for grounding the complementary plug (not shown) and a pair of soldering fingers 502 outwardly extending. The grounding terminal 200 has a flat base 201, a grounding arm 203 upwardly depending from the base 201 and a soldering finger 202 rearwardly and horizontally extending from a middle rear edge of the base 201. The first contact 300 includes a flat base 301, a soldering finger 302 depending outwardly from a bottom edge of the base 301, and a longitudinal engaging arm 303 continuing forwardly from the base 301. The second contact 400 has an elongated base 401, a soldering finger 402 outwardly depending from a bottom edge of the base 401, and a longitudinal engaging arm 403 depending rearwardly from the base 401. The engaging arm 303 of the first contact 300 and the engaging arm 403 of the second contact 400 are laterally spaced from each other and cooperate for mating with the inserted complementary plug (not shown).

In assembly, the first contact 300 and the second contact 400 are respectively located at right and left interior sides of the case 103 of the housing 101. The grounding terminal 200 is forwardly inserted from a rear end of the housing 101. The shroud 500 is then engaged with the outside of the case 103.

As can be seen, since the first contact 300 and the second contact 400 engage with the inserted plug (not shown) at lateral sides of the plug (not shown), the conventional connector 6 has great transverse dimension. Moreover, the engaging beams 303 and 403 are substantially linear so that they have less rigidities thereof, unsuitable for reliable engagement with the inserted plug (not shown).

Hence, an improved electrical connector is required to overcome the disadvantages of the prior art.

BRIEF SUMMARY OF THE INVENTION

An object of the present invention is to provide a connector with contacts which possesses desirable resiliency.

To achieve the above-mentioned object, a connector provided includes a housing with a rectangular case, a dielectric holding member enclosed by the case, a first contact and a pair of second contacts. The case defines two slots, in each of two opposite sides thereof. The holding member has an irregular body, a pair of grooves in lateral sides of the body, and a cutout in a rear end of the body. A pair of latches and a pair of blocks extend outwardly from the body.

The first contact has a base and a connecting plate connecting a soldering plate with the base, and a pair of engaging plates extending upwardly from-the base. The engaging plate is configured to mating with an inserted plug.

Each second contact has a beam, a soldering pad projecting outwardly from a bottom end of the beam, and an engaging beam extending inwardly from a top end of the beam. A pair of shoulders projects from lateral sides of the beam. The engaging beam has a stamped engaging projection at a free end thereof for reliable contacting a mated plug. The shoulders engage with the holding member so that a cantilever is formed by a part of the beam above the shoulders providing desired resiliency thereof.

In assembly, the first contact is retained on the holding member by means of the connecting plate thereof mating with the cutout. The second contacts are retained in the holding member by means of the beam fitting in the grooves and the pair of shoulders downwardly pressing against the body of the holding member. Then, the housing downwardly encloses the holding member by the latches and the blocks fitting with the slots thereof thereby securing the first and the second contacts therebetween.

Other objects, advantages and novel features of the invention will become more apparent from the following detailed description of the present embodiment when taken in conjunction with the accompanying drawings.

DETAILED DESCRIPTION OF THE INVENTION

Figure 1:
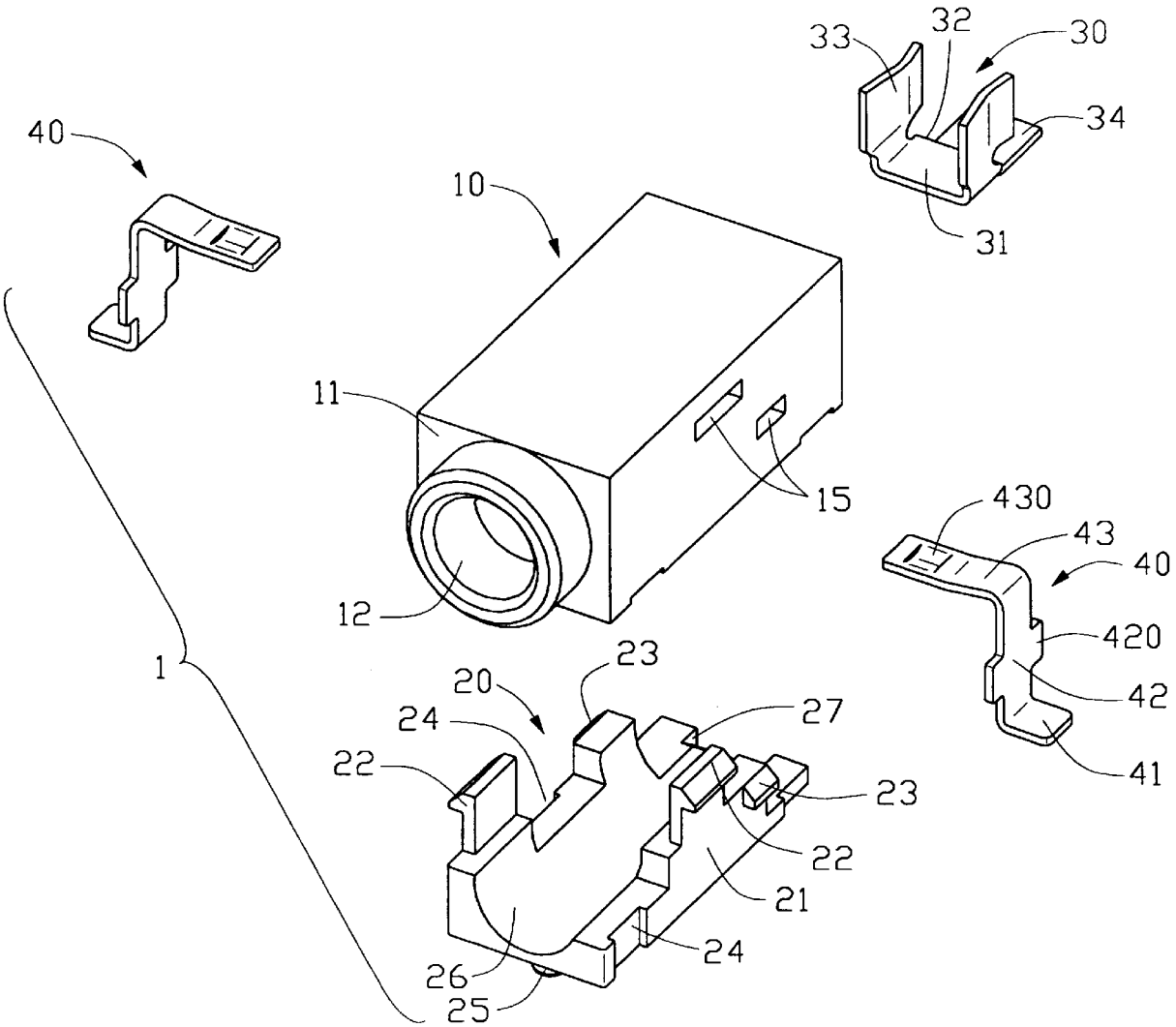
FIG. 1 is an exploded view of an electrical connector of the present invention.

Referring to FIG. 1, an electrical connector 1 of the present invention comprises a dielectric housing 10, an insulative holding member 20 disposed in a bottom of the housing 10, a first contact 30 and a pair of second contacts 40.

Figure 2:
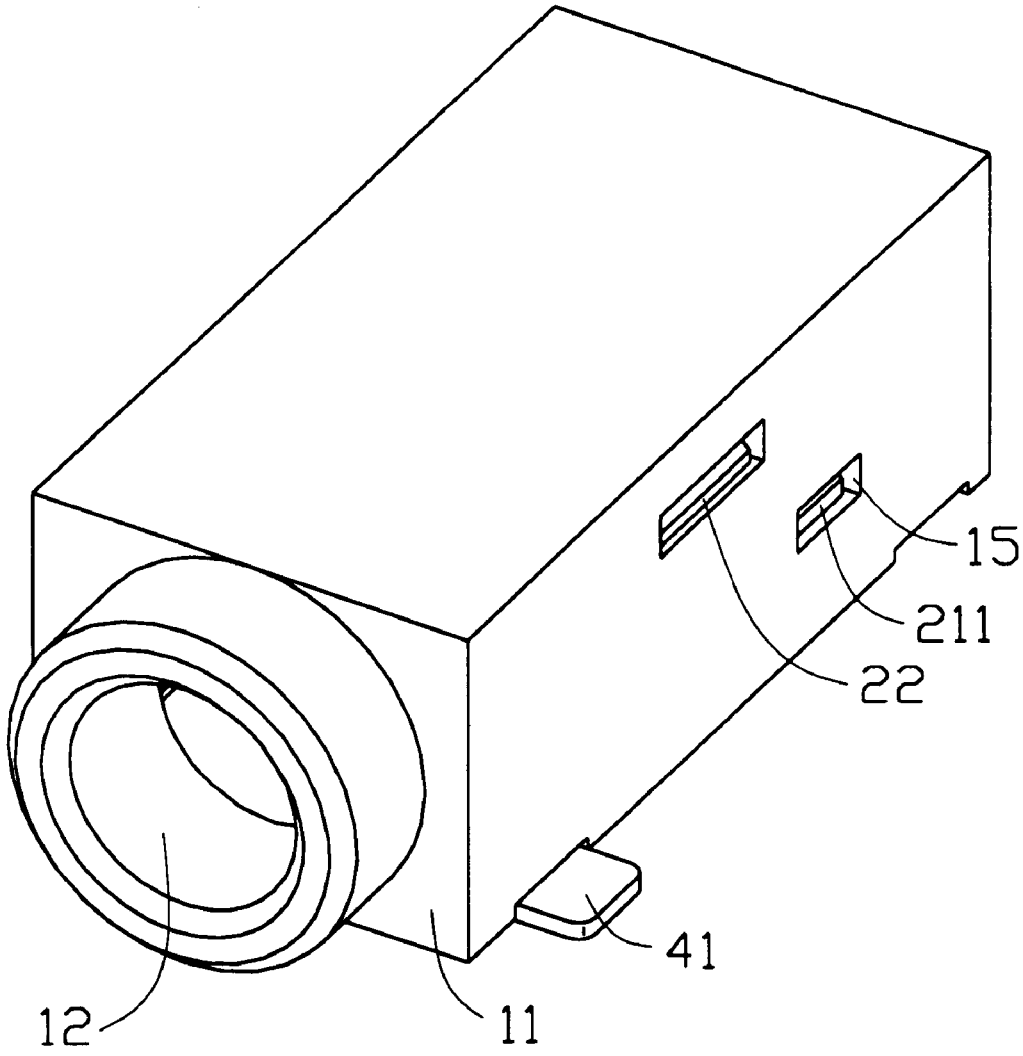
FIG. 2 is an assembled view of the connector of FIG. 1.
Figure 3:
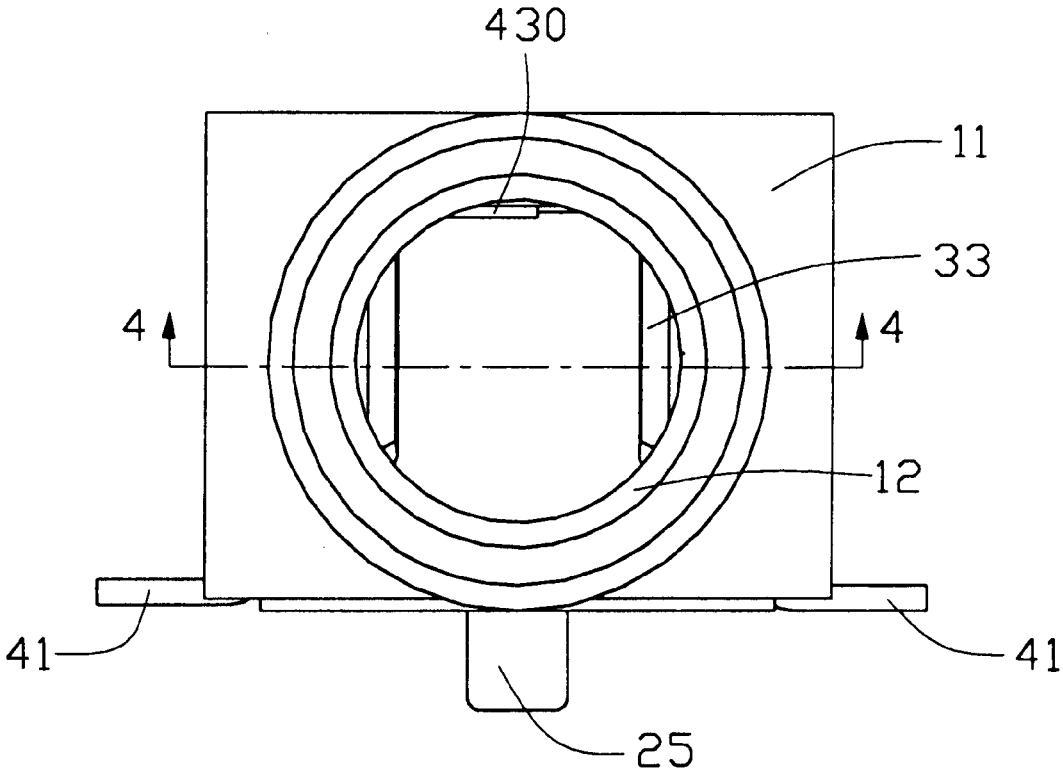
FIG. 3 is a front view of FIG. 2.

The housing 10 is consisted of an elongate rectangular case 11 and a sleeve 12 forwardly extending from the case 11. The case 11 defines two slots 15 in each of two opposite sides of the case 11 (only one side shown), of which one is approximate a top side of the case 11 and the other is at a middle of the case 11 (see FIG. 2).

The insulative holding member 20 includes an irregular body 21, a pair of latches 22, a pair of blocks 23 and a pair of mounting legs 25 downwardly projecting from a bottom thereof. The body 21 defines a pair of grooves 24 in lateral sides thereof, an arcuate recess 26 between lateral sides thereof for guiding a plug 6 (see FIG. 5) into the connector 1, and a cutout 27 at a rear end thereof. The latches 22 and the blocks 23 project outwardly from the body 21 for interlocking within the slots 15 in the housing 10.

The first contact 30 has a flat base 31, a connecting plate 32 downwardly bending from a rear end of the base 31 and connecting with a soldering plate 34, and a pair of engaging plates 33 extending upwardly from lateral edges of the base 31. Each engaging plate 33 has a curved configuration bent toward a middle of the first contact 30; furthermore, the engaging plate 33 slightly inclines toward the middle of the first contact 30. Therefore, the engaging plates 33 can reliably mate with a tapered head of the plug 6 (see FIG. 5). The first contact 30 is mounted onto the holding member 20. The soldering plate 34 is used for surface mounting the connector 1 on a circuit board (not shown).

Each second contact 40 includes an elongate beam 42, an engaging beam 43 extending perpendicularly from a top end of the beam 42 toward a middle of the housing 10, and a soldering pad 41 bent perpendicularly from a bottom end of the beam 42 away from the housing 10. A pair of shoulders 420 flanks with lateral edges of the beam 42. An engaging projection 430 is formed by stamping downwardly a part of a free end of the engaging beam 43 for ensuring that the engaging beams 43 can have a reliable engagement with the mated plug 6 (see FIG. 5). The soldering pad 41 is adapted for surface mounting on the circuit board (not shown). The shoulders 420 have an engagement with the housing 10 so that a cantilever is formed by a part of the beam 42 above the shoulders 420; the cantilever feature provides the engaging beam 43 with an improved compliance to ensure that the engaging beam 43 can have a reliable engagement with the inserted plug 6. The second contact 40 is so designed that improvement of resiliency thereof reduces the risk of permanent set. Each second contact 40 bends twice, the engaging beam 43 and the soldering pad 41 being substantially right angle with respective to the beam 42, and thus provides necessary rigidity thereof.

In assembly, further referring to FIGS. 2 to 5, the connecting plate 32 is used to fit within the cutout 27 of the holding member 20 whereby the base 31 overlapps on a top surface of a rear end portion of the body 21 of the holding member 20 adjacent the cutout 27. The soldering plate 34 projects out of a rear edge of the holding member 20 and has a bottom surface coplanar with a bottom surface of the holding member 20. Each second contact 40 is fixed in a corresponding groove 24 of the holding member 20 by means that the beam 42 thereof is received in the groove 24 while the shoulders 420 thereof fit against a top surface of the body 21 around the groove 24. The case 11 of the housing 10 then downwardly assembled to the holding member 20 to enclose the holding member 20 with the contacts 30, 40 whereby securing the contacts 30, 40 in the housing 10. The case 11 of the housing 10 and the holding member 20 are assembled by the latches 22 and blocks 23 fitting within the corresponding slots 15.

Figure 4:
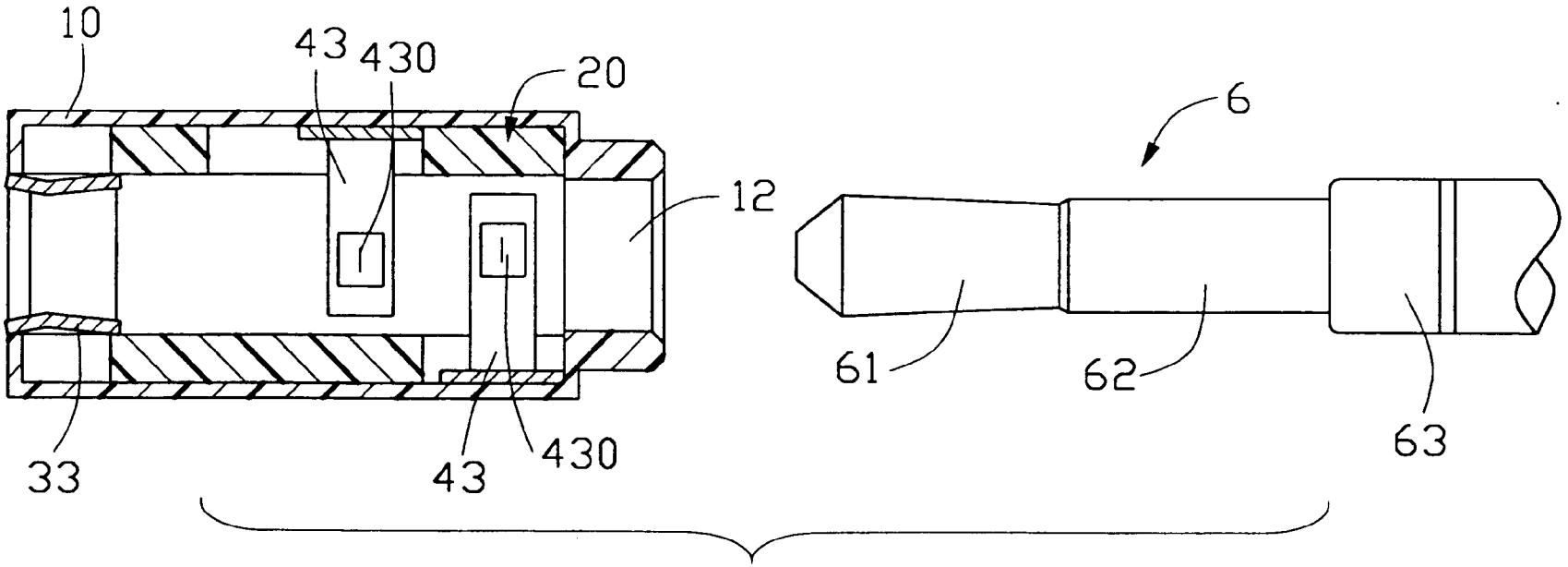
FIG. 4 is a view showing the connector in cross section taken along line 4—4 of FIG. 3 and a complementary plug to be engaged with the connector.
Figure 5:
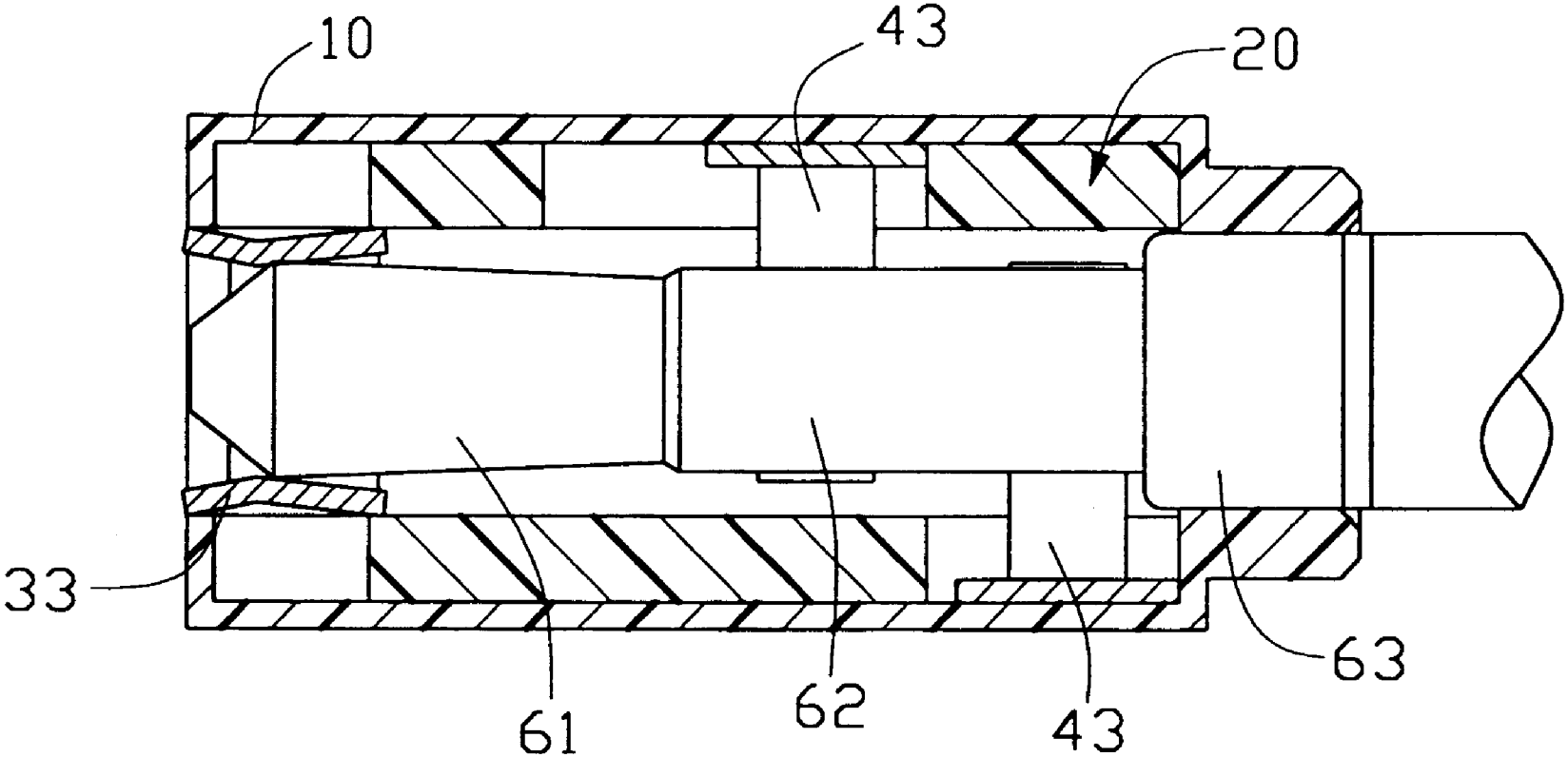
FIG. 5 is a view similar to FIG. 4 with the complementary plug fully inserted into the connector.
Figure 6:
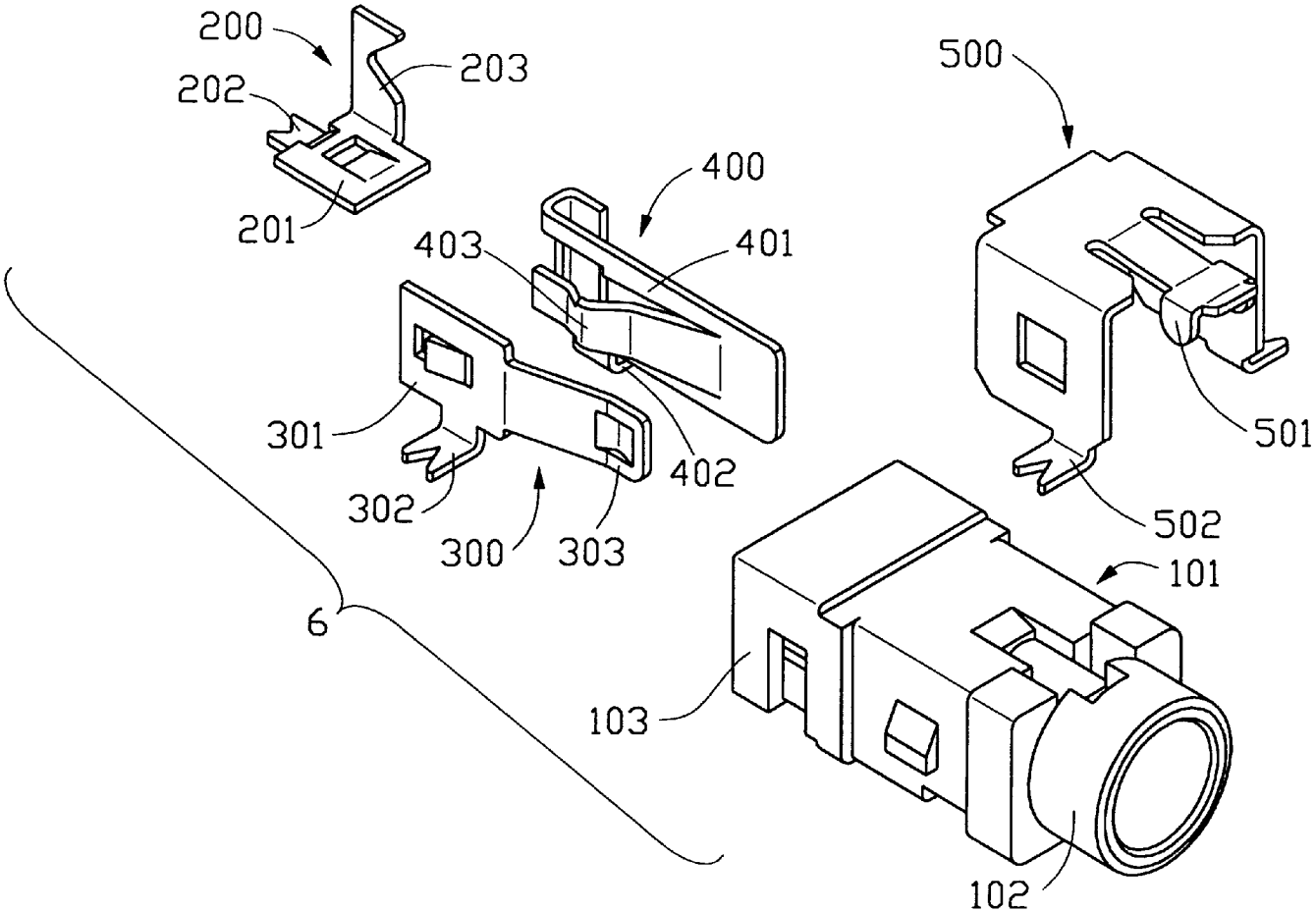
FIG. 6 (PRIOR ART)
FIG. 6 is an exploded view of a conventional connector.

The complementary plug 6 consists of a first section 61, a second section 62 and an outer section 63. Referring to FIGS. 4 and 5, the plug 6 sequentially extends through the sleeve 12 and the case 11 to engage with the connector 1 for establishing an electrical connection with the connector 1. The engaging beams 43 of the second contacts 40 then downwardly press against the second section 62 and the engaging plates 33 of the first contact 30 mate with the first section 61 while the outer section 63 is received in the sleeve 12.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising a dielectric housing, a holding member received at a bottom end of the housing and having a pair of grooves at lateral sides thereof and a cutout at a rear side thereof, a first contact seated in the cutout and a pair of second contacts fixed in the grooves, a plug inserted into the housing the improvement comprising:

each second contact includes a base, an engaging beam depending inwardly from an end of the base, and a soldering beam projecting outwardly from an end of the base, the base further having a pair of shoulders projecting from lateral sides thereof;

wherein the engaging beam has an engaging projection at an end thereof;

wherein the base of each second contact is fixed in the respective groove, and wherein the shoulders press against the body for securing the second contact in the holding member;

wherein the second contacts are sandwiched between said housing and said holding member and are engaged with said plug at two different axial positions.

* * * * *